US006238784B1

(12) United States Patent
Mochizuki et al.

(10) Patent No.: US 6,238,784 B1
(45) **Date of Patent: *May 29, 2001**

(54) INK-JET RECORDING SHEET

(75) Inventors: Yoshihiro Mochizuki; Masaru Tsuchiya, both of Hino (JP)

(73) Assignee: Konica Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/876,982

(22) Filed: Jun. 16, 1997

(30) Foreign Application Priority Data

Jun. 20, 1996 (JP) ..... 8-159759

(51) Int. Cl.[7] ..... B41M 5/00

(52) U.S. Cl. ..... 428/321.1; 428/195; 428/327; 428/328; 428/329; 428/330; 428/331

(58) Field of Search ..... 428/195, 522, 428/328–331, 321.1, 327

(56) References Cited

U.S. PATENT DOCUMENTS

| | | | | |
|---|---|---|---|---|
| 4,902,568 | * | 2/1990 | Morohoshi | 428/331 |
| 5,006,407 | | 4/1991 | Malhotra . | |
| 5,073,448 | * | 12/1991 | Vieira et al. | 428/211 |
| 5,302,439 | | 4/1994 | Malhotra et al. . | |
| 5,478,631 | * | 12/1995 | Kawano et al. | 428/195 |
| 5,576,088 | * | 11/1996 | Ogawa et al. | 428/195 |
| 5,635,297 | * | 6/1997 | Ogawa et al. | 428/342 |

FOREIGN PATENT DOCUMENTS

WO 92/03288 3/1992 (WO) .

OTHER PUBLICATIONS

Patent Abstracts of Japan, vol. 006, No. 074 (1982) of JP 57 014091A.

* cited by examiner

*Primary Examiner*—Pamela R. Schwartz
(74) *Attorney, Agent, or Firm*—Frishauf, Holtz, Goodman, Langer & Chick, P.C.

(57) ABSTRACT

An ink-jet recording sheet comprises a support, and provided thereon, an ink absorption layer containing solid fine particles, a hydrophilic binder, and oil drops in an amount of 5 to 50 weight % based on the solid fine particle weight, the content ratio by weight of the solid fine particles to the hydrophilic binder being 2 to 200, wherein the oil drops comprise an hydrophobic organic compound having a melting point of 40° C. or less or polymer particles having a glass transition temperature of 40° C. or less.

13 Claims, No Drawings

INK-JET RECORDING SHEET

FIELD OF THE INVENTION

The present invention relates to a recording sheet for ink-jet recording, and particularly to a recording sheet with improved ink absorption property.

BACKGROUND OF THE INVENTION

Ink jet recording records an image or text on a recording sheet such as a paper sheet, applying various principles. This recording method has advantages in providing a relatively high speed recording, low noise and easy color image formation. There have been problems in maintenance or ink clogging of nozzles in this method, but improvements have been made in the ink and related device, and this method has been widely applied to various fields such as printers, facsimile devices and computer terminals.

It is required for ink recording sheet to accept printing dots at high density and bright image tone, to provide rapid ink absorption property producing no ink diffusion or blur in overlapped printed dots, and to provide printing dots with smooth periphery and no blurring in which printing ink is not so greatly diffused.

In recording sheets slow in ink absorption, two or more kinds of color ink drops repel one another at overlapped ink recording portions on the sheet, resulting in image unevenness, or different color inks at different but adjacent ink recording portions on the sheet are diffused and mixed, resulting in deterioration of image quality. Therefore, a recording sheet having high ink absorption property is eagerly sought.

Many techniques have been proposed in order to solve the above described problems.

There have been proposed, for example, an ink jet recording sheet paper of low size content wetted with surface treatment coating disclosed in Japanese Patent O.P.I. Publication No. 52-53012, an ink jet recording sheet paper comprising a support and provided thereon, an ink absorption layer disclosed in Japanese Patent O.P.I. Publication No. 55-5830, an ink jet recording sheet paper comprising a layer containing non-colloidal silica powder as pigment disclosed in Japanese Patent O.P.I. Publication No. 56-157, an ink jet recording sheet paper comprising an inorganic and organic pigment disclosed in Japanese Patent O.P.I. Publication No. 57-107878, an ink jet recording sheet paper comprising two void distribution peaks disclosed in Japanese Patent O.P.I. Publication No. 58-110287, an ink jet recording sheet paper comprising two upper and lower porous layers disclosed in Japanese Patent O.P.I. Publication No. 62-111782, an ink jet recording sheet paper comprising amorphous cracks disclosed in Japanese Patent O.P.I. Publication Nos. 59-68292, 59-123696 and 60-18383, an ink jet recording sheet paper comprising a fine powder layer disclosed in Japanese Patent O.P.I. Publication Nos. 61-135786, 61-148092 and 62-149475, an ink jet recording sheet paper comprising pigments or fine particle silica each having a specific physical property disclosed in Japanese Patent O.P.I. Publication Nos. 63-252779, 1-108083, 2-136279, 3-65376 and 3-27976, an ink jet recording sheet paper comprising fine particle silica such as colloidal silica disclosed in Japanese Patent O.P.I. Publication Nos. 57-14091, 60-219083, 60-210984, 61-20797, 61-188183, 5-278324, 6-92011, 6-183134, 7-137431 and 7-276789, or an ink jet recording sheet paper comprising hydrated alumina fine particles disclosed in Japanese Patent O.P.I. Publication Nos. 2-276671, 3-67684, 3-215082, 3-251488, 4-67986, 4-263983 and 5-16517.

An ink receiving layer, if it is a layer (hereinafter referred to as a void layer) having many voids to absorb or support ink, has good ink absorption property and provides high image quality with no blurring.

The void volume occasionaly changes during storage under high temperature and high humidity, and the void layer preferably contains solid fine particles to keep the void volume constant.

It is necessary that, in order to obtain a stable void layer containing solid fine particles, a hydrophilic binder be incorporated in the void layer. However, if the addition amount of the hydrophilic binder is too large relative to that of the solid fine particles, it has problems in that the hydrophilic binder fills spaces formed among the solid fine particles or swells at initial ink absorption to fill voids in the void layer and results in deterioration of ink absorption. Accordingly, the addition amount of the hydrophilic binder is limited.

The present inventors have made an extensive study and have found that the addition amount ratio by weight of the hydrophilic binder to the solid fine particles is necessary to be about 2 to 200. However, a high addition amount ratio of the solid fine particles brings about layer brittleness, and fine cracks occur on the ink absorption layer surface, particularly during storage under low humidity. When ink jet recording ink is provided on the recording sheet having such high addition amount ratio of the solid fine particles, the recording ink diffuses along the cracks occurred, resulting in serious deterioration of image quality.

SUMMARY OF THE INVENTION

The present invention has been made in view of the above.

An object of the invention is to provide an ink jet recording sheet, comprising an ink absorption layer with high ink absorption property containing solid fine particles dispersed in a hydrophilic binder, which is capable of giving a high quality image without bringing about the ink absorption layer brittleness, even after storage under low humidity condition.

DETAILED DESCRIPTION OF THE INVENTION

The above objects of the invention can be attained by the followings:

1. an ink-jet recording sheet comprising a support, and provided thereon, an ink absorption layer containing solid fine particles, a hydrophilic binder, and oil drops in an amount of 5 to 50 weight % based on the solid fine particle weight, the content ratio by weight of the solid fine particles to the hydrophilic binder being 2 to 200, wherein the oil drops comprise an hydrophobic organic compound having a melting point of 40° C. or less or polymer particles having a glass transition temperature of 40° C. or less, 2. the ink-jet recording sheet of item 1 above, wherein the oil drops have an average oil drop size of 0.05 to 0.5 $\mu$m, 3. the ink-jet recording sheet of item 1 above, wherein the solid fine particles are selected from the group consisting of silica, calcium carbonate, alumina, hydrated alumina and magnesium silicate, each having an average primary order particle size of 7 to 80 nm, 4. the ink-jet recording sheet of item 1 above, wherein the solid fine particles are manufactured by a gas phase reaction method, 5. the ink-jet recording sheet of item 1 above, wherein the hydrophilic binder is polyvinyl alcohol or cation-modified polyvinyl alcohols, or 6. the ink-jet recording sheet of item 5 above, wherein the hydrophilic binder has an average polymerization degree of 2,000 to 4,000.

The present invention will be detailed below.

The solid fine particles used in the invention include conventional solid fine particles usually used for ink recording sheet. The inorganic fine particles are preferable as fine particles, and include white inorganic pigment such as light calcium carbonate, heavy calcium carbonate, magnesium carbonate, kaolin, clay, talc, calcium sulfate, barium sulfate, titan dioxide, zinc oxide, zinc hydroxide, zinc sulfide, zinc carbonate, hydrosulfite, aluminum silicate, diatomaceous earth, potassium silicate, magnesium silicate, synthetic non-crystalline silica, colloidal silica, alumina, colloidal alumina, hydrated alumina, pseudo-boehmite, aluminum hydroxide, lithopone, zeolite, and magnesium hydroxide. These inorganic fine particles may be used by being uniformly dispersed in a binder in primary order particle form or in aggregated secondary order particle form.

The organic fine particles include polystyrene, polymethacrylates, polyacrylamides, polyethylene, polypropylene, polyvinyl chloride, polyvinylidene chloride or coplymers thereof, or a urea resin or a melamine resin.

In the invention, inorganic solid fine particles are preferably used in obtaining a void layer having a relatively high void ratio. Silica, calcium carbonate, magnesium silicate, alumina or hydrated alumina among the inorganic solid fine particles, since high glossiness and high density image are easy to obtain.

Conventional various silica fine particles can be used as silica fine particles preferably used in the ink jet recording sheet of the invention.

The silica fine particles include synthetic silica synthesized by a wet method or a gas phase reaction, colloidal silica, porous silica in which primary particles aggregate to secondary particles and silica if any shape. The examples thereof include synthetic amorphous silica disclosed in Japanese Patent O.P.I. Publication Nos. 55-51583 and 56-148583, silica super fine particles disclosed in Japanese Patent O.P.I. Publication No. 60-204390, fluorine-containing synthetic amorphous silica disclosed in Japanese Patent O.P.I. Publication No. 60-222282, synthetic amorphous silica surface-treated with a silane coupling agent disclosed in Japanese Patent O.P.I. Publication Nos. 60-224580 and 62-178384, spherical silica disclosed in Japanese Patent O.P.I. Publication Nos. 62-183382 and 63-104878, synthetic silica fine particles containing $Na_2O$ in an amount of 0.5% by weight or more disclosed in Japanese Patent O.P.I. Publication No. 63-317381, synthetic silica fine particles having a specific surface area of 100 $m^2/g$ disclosed in Japanese Patent O.P.I. Publication No. 1-115677, synthetic silica fine particles surface-treated with alumina disclosed in Japanese Patent O.P.I. Publication No. 62-286787, synthetic silica fine particles surface-treated with Ca, Mg or Ba disclosed in Japanese Patent O.P.I. Publication No. 1-259982, synthetic silica fine particles having an oil absorption of 180 ml/g or more, colloidal silica disclosed in Japanese Patent O.P.I. Publication No. 57-14091, cationic colloidal silica disclosed in Japanese Patent O.P.I. Publication Nos. 60-219084, 6-92011, 6-297830 and 7-81214 and beaded or branched colloidal silica disclosed in Japanese Patent O.P.I. Publication No. 5-278324 and 7-81214.

Silica super fine particles with an average particle size of 7 to 80 nm is preferably used in order to obtain high glossiness or high void amount. The silica super fine particles may be surface-modified with a cation or surface-treated with Al, Ca, Mg or Ba. In the invention, silica synthesized by a gas phase reaction is most preferable.

Calcium carbonate preferably used in the ink jet recording sheet of the invention includes light calcium carbonate having a predetermined specific surface area disclosed in Japanese Patent O.P.I. Publication Nos. 57-12486, 57-129778, 58-55283 and 61-20792, needle calcium carbonate disclosed in Japanese Patent O.P.I. Publication Nos. 63-27277 and 4-250091, calcium carbonate fine particles in which needle primary particles aggregate to needle secondary particles disclosed in Japanese Patent O.P.I. Publication No. 3-251487, needle rhombic algodonite calcium carbonate having a specific oil absorption disclosed in Japanese Patent O.P.I. Publication Nos. 4-250091 and 4-260092, and spherical sedimentating calcium carbonate disclosed in Japanese Patent O.P.I. Publication No. 7-40648.

The calcium carbonate has an average particle size of preferably 7 to 80 nm, since it provides high glossiness or high void amount.

The magnesium silicate preferably used in the invention may be amorphous, spherical or tabular, but is preferably tabular. The average particle size of the tabular magnesium silicate is represented by a diameter of circle having an area corresponding to the average projected area of the tabular magnesium silicate, and is preferably 7 to 80 nm.

The alumina or hydrated alumina preferably used in the invention may be crystalline or non-crystalline, and may be amorphous, spherical or needle particles or may be of any shape.

The average particle size of the above solid fine particles is represented by a diameter of a circle having an area corresponding to the average projected area of particles photographed by an electron microscope.

The above solid fine particles preferably used in the invention is especially preferably primary particles having an average particle size of 7 to 80 nm.

It is necessary in the ink jet recording sheet of the invention that a hydrophilic binder be contained in the solid fine particle-containing layer in order to form a layer film.

The hydrophilic binder herein referred to is a polymer having a solubility at room temperature in water of 0.1 weight % or more.

The hydrophilic binder used in the ink jet recording sheet of the invention includes gelatin or its derivative, polyvinyl pyrrolidone (having an average molecular weight of preferably about 200,000 or more), pullulan, polyvinyl alcohol or its derivative (having an average molecular weight of preferably about 20,000 or more), polyethylene glycol (having an average molecular weight of about 100,000 or more), carboxymethyl cellulose, hydroxyethyl cellulose, dextrane, dextrin, polyacrylic acid or its salt, agar, κ-carrageenin, λ-carrageenin, τ-carrageenin, xanthan gum, locust bean gum, alginic acid, gum arabic, polyalkyleneoxide copolymers disclosed in Japanese Patent O.P.I. Publication Nos. 7-195826 and 7-9757, a water-soluble polyvinyl butyral, and a homopolymer or copolymer obtained by polymerizing a vinyl monomer having a carboxy group or a sulfonic acid group disclosed I Japanese Patent O.P.I. Publication No. 62-245260. These hydrophilic binders may be used singly or in combination.

It is preferable in less moisture absorption, less tackiness and less blurring after ink jet recording that the ink absorption layer contain at least polyvinyl alcohol or cation-modified polyvinyl alcohol.

The polyvinyl alcohol has an average polymerization degree of preferably 500–4,000, and more preferably 2,000–4,000 in minimizing crack occurrence. The polyvinyl alcohol has a saponification degree of preferably 70 to 100%, and more preferably 80 to 99%.

The cation-modified polyvinyl alcohol is obtained by saponificated a copolymer of vinyl actate and an ethylenically unsaturated monomer having a cationic group.

The ethylenically unsaturated monomer having a cationic group includes tri-methyl-(2-acrylamide-2,2-dimethylethyl) ammonim chloride, tri-methyl-(3-acrylamide-3,3-dimethylpropyl)ammonim chloride, N-vinylimidazole, N-vinyl-2-methylimidazole, N-(3-dimethylaminopropyl) methacrylamide, tri-methyl-(3-methacrylamidopropyl) ammonim chloride, and N-(1,1-dimethyl-3-dimethylaminopropyl) acrylamide.

The content of the monomer having a cationic group in the cation-modified polyvinyl alcohol is preferably 0.1 to 10 mol %, more preferably 0.2 to 5 mol%, based on the vinyl acetate content. The cation-modified polyvinyl alcohol has an average polymerization degree of ordinarily 500 to 4,000, preferably 2,000 to 4,000. The saponification degree of the vinyl acetate group is ordinarily 60 to 100%, and preferably 70 to 99%.

The layer containing solid fine particles in the invention contains the above polyvinyl alcohol or cation-modified polyvinyl alcohol in an amount of preferably 60% or more by weight, more preferably 80 to 100% by weight based on the total hydrophilic binder weight.

In the ink jet recording sheet of the invention, the weight ratio of the solid fine particles to the hydrophilic binder is 2 to 200 in the ink absorption layer. The low void ratio as in the ratio less than 2 requires a large layer thickness to completely absorb ink, the large thickness resulting in various problems, or the low void ratio swells the layer by ink absorption of the binder and lowers ink absorption speed of the layer. On the other hand, the ratio exceeding 200 brings about layer brittleness even by employing various counter measures described later, resulting in poor image quality. The ratio is preferably 2.5 to 100, and especially preferably 3 to 50. When the silica synthesized by a gas phase reaction is used as solid fine particles, the ratio is especially preferably 3 to 20.

The ink absorption layer of the ink jet recording sheet of the invention has a high solid fine particle content to the hydrophilic binder, and in order to improve the layer brittleness caused by the high solid fine particle content, it is necessary that the ink absorption layer contain oil drops in an amount of 5 to 50 weight % based on the solid fine particle weight.

The oil drops herein referred to include two kinds of groups, the first one is oil drops comprising a hydrophobic organic compound with a melting point of 40° C. or less, preferably −40 to 40° C. and the second one is oil drops comprising polymer particles having a glass transition temperature of 40° C. or less, preferably −40 to 40° C. The polymer particles are preferably obtained from those dispersed in a polymer latex. The hydrophobic organic compound is an organic compound having a solubility in water at room temperature of 0.1 weight % or less, preferably 0.01 weight % or less.

The hydrophobic organic compound includes a conventional hydrophobic high boiling point organic solvent and a hydrophobic polymer with a melting point of 40° C. or less. The hydrophobic compound includes phthalates (for example, dibutylphthalate, dioctylphthalate, diisodecylphthalate), phosphates (for example, tricresylphosphate, trioctylphosphate), fatty acid esters (for example, butyl stearate, bis(2-ethylhexyl) sebatate, ethylene glycol distearate, glycerol tributylate), amides (for example, N,N-diethyllaurylamide, N,N-diethyl-2-(2,5-di-t-amylphenoxy)butanamide), ethers (for example, ethylene glycol dibutylether, decylether, dibenzylether), silicone oil and liquid paraffin.

The hydrophobic polymer includes poly(2-ethylhexyl methacrylate), polybutyl methacrylate, coploy (butylacrylate/hydroxyethyl methacrylate, 90/10), polyvinyl acetate, polyvinyl propionate, coploy(butylacrylate/t-butylacrylate/2-ethylhexyl methacrylate/styrene, 60/20/10/10). The hydrophobic polymer has an average molecular weight of preferably 5,000 to 100,000. The hydrophobic polymer having an average molecular weight exceeding 100,000 is difficult to form fine oil drops by an emulsifying method described later.

The hydrophobic organic compound is emulsified in a hydrophilic binder preferably in a surfactant employing a high speed homoginizer or a a high pressure homogenizer. It is preferable in forming fine oil drops that the emulsification is carried out in the presence of a low boiling point organic solvent such as ethyl acetate, propyl acetate, methylethyl ketone, acetone, or N,N-dimethylformamide. On emulsification, another hydrophobic organic compound (such as a UV absorbent, a brightening agent or an image stabilizing agent) exceeding a melting point of 40° C. can be used in combination, but preferably, oil drops contain 50 or more weight % of a compound with a melting point of 40° C. or less.

The second one, the polymer latex containing polymer particles having a glass transition temperature of 40° C. or less is a polymer latex obtained by an emulsion polymerization method, for example, a styrene-butadiene coploymer latex, polyacrylate latex, a polymethacrylate latex, a polyvinyl acetate latex, or an ethylene-vinyl acetate coploymer latex. The example thereof includes styrene-butadiene (7/3) latex, polyvinyl acetate latex, vinyl acetate-ethylene (9/1) latex, vinyl acetate-ethylmethacrylate (5/5) latex, vinyl chloride-ethylacrylate (3/2) latex, ethylacrylate-methylacrylate-HEMA (5/4/1) latex, styrene-butylacrylate-HEMA (1/6/3) latex, and silicone latex. In the above, the number in the parenthesis represents a copolymerization mol ratio, and HEMA represents hydroxyethylmethacrylate.

The average oil drop size of the oil drops is preferably 0.05 to 0.5 $\mu$m. The oil drop content of the ink absorption layer is 5 to 50 weight %, preferably 10 to 40 weight %, based on the solid fine particle weight content. When the oil drop content is less than 5 weight %, brittleness of the absorption layer is not sufficiently improved. In contrast, when the oil drop content exceeds 50 weight %, the void ratio of the absorption layer is lowered, and ink absorption and glossiness of the absorption layeris is likely to be deteriorated.

The solid fine particle content of the ink absorption layer is preferably 7 to 35 g/m$^2$, and more preferably 10 to 30 g/m$^2$.

The ink-jet recording sheet of the invention may comprise two or more ink absorption layers containing a hydrophilic binder and solid fine particles. In the above plural layers, kinds of the hydrophilic binder and solid fine particles or the content ratio of the hydrophilic binder and solid fine particles may be suitably selected, but at least one ink absorption layer has a content ratio by weight of the solid fine particles to the hydrophilic binder of 2 to 200 and contains the oil drops. The thickness of the ink absorption layer is preferably 10 to 60 $\mu$m, and more preferably 20 to 50 $\mu$m.

The ink-jet recording sheet of the invention has an ink absorption layer containing the above described solid fine particles and hydrophilic binder, and may further have another hydrophilic layer. Such another hydrophilic layer is preferably provided farther from the support than the ink absorption layer on the ink absorption layer side. The hydrophilic layer has a dry thickness of 2 μm or less and preferably 1.5 μm or less, in view of ink absorption speed.

Any layer on the ink absorption layer side of the support in the ink-jet recording sheet of the invention optionally contains various additives.

The additives include a UV absorbent disclosed in Japanese Patent O.P.I. Publication Nos. 57-74193, 57-87988 and 62-261476, an anti-fading agent disclosed in Japanese Patent O.P.I. Publication Nos. 57-74193, 57-87988, 60-72785, 61-146591, 1-95091 and 3-13376, an anionic, cationic or nonionic surfactant, and a fluorescent brightening agent, a pH adhusting agent such as sulfuric acid, phosphoric acid, citric acid, sodium hydroxide, potassium hydroxide or potassium carbonate, an anti-forming agent, a wetting agent such as ethylene glycol, an anti-septic agent, a thickner, a haredener, an anti-static agent and a matting agent disclosed in Japanese Patent O.P.I. Publication Nos. 59-42993, 59-52689, 62-280069, 61-24287 and 4-219266.

The hardener includes an inorganic or organic hardener such as chrom alum, formaldehyde, glyoxal, an epoxy compound, a vinyl sulfone compound, an acroyl compound, a s-triazine compound, an N-methylol compound, a carbodiimide compound or an ethyleneimine compound.

The solid coating amount of a layer on the ink recording surface side of the support in the ink jet recording sheet of the invention is not specifically limited, but is preferably about 10 to 40 g/m$^2$, and more is preferably about 20 to 30 g/m$^2$. The layer is preferably thinner in view of minimizing curling of the recording sheet after recording.

The layer on the ink recording surface side of the support in the ink jet recording sheet of the invention may contain, as a water resistant agent, a polycationic electrolyte disclosed in Japanese Patent O.P.I. Publication No. 56-84992, a polyarylamine disclosed in Japanese Patent Publication No. 4-15744 and Japanese Patent O.P.I. Publication Nos. 61-58788 and 62-174184 or an alkali metal salt of a weak acid disclosed in Japanese Patent O.P.I. Publication No. 61-47290.

The support used in the ink jet recording sheet of the invention includes well-known, conventional supports for a ink jet recording sheet.

The transparent support in the invention includes a resin film or plate such as a polyester resin, a polyester resin, a diacetate resin, a triacetate resin, an acryl resin, a polycarbonate resin, a polyvinyl chloride resin, a polyimide resin, cellophane or celluloid and a glass plate. The support is preferably a heat resistant film, when used for an over-head projector, and especially preferably a polyethylene terephthalate film. The thickness of the transparent support is preferably about 10 to 200 μm.

The translucent support includes a sheet or plate such as paper, resin-coat paper, cloth, wood or metal and a support in which the above transparent support is made translucent by a well-known method. The translucent support is preferably a resin-coat paper (so-called RC paper) in which a polyolefin resin containing white pigment is provided at least one surface of a base paper sheet or a polyethylene terephthalate sheet (so-called white PET) containing white pigment.

The present invention is markedly effected especially by a water-repellent support, and the especially preferable is a plastic support such as a transparent or translucent polyethylene terephthalate or a support in which a hydrophobic resin such as a polyethylene resin is coated on both surfaces of a base paper sheet.

In order to increase adhesion between a support and an ink receiving layer comprising the ink absorption layer, the support is preferably subjected to corona discharge treatment or subbing treatment before the ink receiving layer coating. The ink jet recording sheet of the invention need not be colorless, and may be colored.

In the manufacture the ink jet recording sheet of the invention, a method of coating the ink receiving layer on a support can be selected from the conventional ones.

The coating method includes a roller coating method, a rod-bar coating method, an air-knife coating method, a spray coating method, a curtain coating method and an extrusion coating method using a hopper disclosed in U.S. Pat. No. 2,681,294.

The water based ink herein referred to is a recording liquid comprising the following colorants, solvents and other additives. The colorant includes a direct dye, an acid dye, a basic die, a reactive dye and food dyes, each being well known in the art.

The solvent for water based ink includes water and a water soluble organic solvent, for example, alcohols such as methyl alcohol, isopropyl alcohol, n-butyl alcohol, tert-butyl alcohol and iso-butyl alcohol, amides such as dimethylformamide and dimethylacetoamide, ketones or ketonealcohols such as acetone and diacetone alcohol, ethers such as tetrahydrofurane and dioxane, polyalkylene glycols such as polyethylene glycol and polypropylene glycol, polyhydric alcohols such as ethylene glycol, propylene glycol, butylene glycol, triethylene glycol, 1,3,6-hexane triol, thiodiglycol, hexylene glycol, diethylene glycol, glycerin and triethanol amine and polyhydric alcohol lower alkyl ethers such as ethylene glycol methylether, diethylene glycol methyl(or ethyl)ether and triethylene glycol monobutylether. Of these, polyhydric alcohols such as diethylene glycol, glycerin and triethanol amine or polyhydric alcohol lower alkyl ethers such as triethylene glycol monobutylether is preferable.

The other additives include a pH adjusting agent, a metal chelating agent, an anti-fungal, a viscosity adjusting agent, a surface tension adjusting agent, a wetting agent, a surfactant and an anti-rust agent.

The water based ink has a surface tension at 20° C. of preferably 25 to 60 dyne/cm, and more preferably 30 to 50 dyne/cm.

EXAMPLES

The invention will be detailed in the following examples, but the invention is not limited thereto. In the examples, "%" represents weight %, unless otherwise specified. The addition amount represents amount per m$^2$ of ink jet recording sheet.

Example 1

The following Coating Solution-1 was coated on a photographic print paper to give a wet thickness of 190 μm, and dried to obtain an ink absorption layer having a dry thickness of 25 μm. Thus, Ink jet recording sheet sample No. 1 was obtained. The paper was one in which a polyethylene film was laminated on both surfaces of a 160 g/m$^2$ base paper, the polyethylene film on an ink recording layer side containing anatase type titanium dioxide in an amount of 12 weight %.

The coating was carried out using a slide hopper coating method, and after the coating, the coated layer was cooled to about 10° C., dried by applying a 10° C. air for 1 minute, and further dried by applying a 30–45° C. air for 4 minutes.

| (Coating Solution-1) | |
|---|---|
| Pure water (Ion-exhange water) | 980 ml |
| Ethanol | 50 ml |
| Silica (silica by a gas phase reaction having an average primary particle size of about 13 nm) | 51 g |
| Polyvinyl alcohol (an average polymerization degree of 3,500, saponification degree of 88%) | 8 g |
| Surfactant-1 (AS-1) | 0.1 g |

AS-1

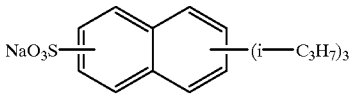

Ink jet recording sheet sample Nos. 2 through 11 were prepared in the same manner as in Ink jet recording sheet sample No. 1, except that additives as shown in Table 1 was further added to Coating Solution 1. Each additive was added in the form of an emulsion in which the additive was emulsified in the polyvinyl alcohol in the presence of AS-1. The total amount of the coating solutions was adjusted with pure water to keep constant.

TABLE 1

| Recording Sheet Sample No. | Additives (mp) | Average Oil Drop Size (μm) | *Addition Amount (wt %) |
|---|---|---|---|
| 2 (Comparative) | Liquid paraffin (mp <10° C.) | 0.3 | 3 |
| 3 (Invention) | Liquid paraffin (mp <10° C.) | 0.3 | 10 |
| 4 (Invention) | Liquid paraffin (mp <10° C.) | 0.3 | 20 |
| 5 (Comparative) | Liquid paraffin (mp <10° C.) | 0.3 | 90 |
| 6 (Comparative) | DIDP (mp = 53° C.) | 0.32 | 3 |
| 7 (Invention) | DIDP (mp = 53° C.) | 0.32 | 10 |
| 8 (Invention) | DIDP (mp = 53° C.) | 0.32 | 20 |
| 9 (Comparative) | DIDP (mp = 53° C.) | 0.32 | 90 |
| 10 (Comparative) | Solid paraffin (mp = 60° C.) | 0.36 | 20 |
| 11 (Comparative) | DPP (mp = 74° C.) | 0.28 | 20 |

DIDP: Diisodecylphthalate
DPP: Diphenylphthalate
*In Table 1, the addition amount represents the additive weight content based on the silica weight.

An evaluation image pattern was printed on each of the above obtained ink jet recording sheet samples using an ink-jet printer MJ-900C produced by Epson Co., Ltd., and evaluated regarding the following items.

(1) Ink Absorption

Yellow and cyan ink were uniformly jetted in 40% of maximum ink jetting amount, respectively, on each of the ink jet recording sheet samples to form a mixture color solid image. The red reflection densities of twenty points of the resulting solid image were measured by a microdensitometer (aperture=200 μmϕ. The standard deviation of the resulting densities was divided by the average density to obtain a variation coefficient. When ink absorption is good and results in an image without unevenness, this coefficient is small, however, when poor ink absorption causes beading among the jetted ink drops and results in an image with unevenness, this coefficient is large.

(2) Layer Brittleness

Each of the samples obtained above was stored at 25° C. and at 20% RH for 24 hours in 60 mm cylindrical form with the recording layer outward, and thereafter, the recording layer surface was observed with a magnifying glass according to the following criteria:

A: No cracks observed

B: Some cracks observed, but no practical problem in image quality

C: Cracks observed, and problem in image quality, but no cracks observed un-aided visually D: Cracks observed un-aided visually, and serious problem in image quality (3) Glossiness Glossiness of the ink absorption layer was measured at an angle of 75° by a glossmeter VGS-1001-DP produced by Nihon Denshoku Kogyo Co., Ltd.

The results are shown in Table 2.

TABLE 2

| Recording Sheet Sample No. | Ink Absorption | Cracks | Glossiness |
|---|---|---|---|
| 1 (Comparative) | 0.04 | D | 61% |
| 2 (Comparative) | 0.04 | D | 61% |
| 3 (Invention) | 0.05 | B | 60% |
| 4 (Invention) | 0.06 | B | 58% |
| 5 (Comparative) | 0.10 | B | 38% |
| 6 (Comparative) | 0.04 | D | 60% |
| 7 (Invention) | 0.05 | B | 61% |
| 8 (Invention) | 0.06 | B | 59% |
| 9 (Comparative) | 0.11 | B | 43% |
| 10 (Comparative) | 0.05 | D | 46% |
| 11 (Comparative) | 0.06 | D | 53% |

As is apparent from Table 2, Recording Sheet Sample Nos. 3, 4, 7, and 8 greatly improved the layer strength without lowering of ink absorption and glossiness. In contrast, Recording Sheet Sample Nos. 2 and 6, which contain oil drops in the mount less than in the invention, exhibited no improved layer strength, and Recording Sheet Sample Nos. 5 and 9, which contain oil drops in the amount more than in the invention, exhibited lowering of ink absorption and glossiness. Further, Samples employing additives having a melting point exceeding 40° C. exhibited no improved layer strength.

Example 2

Ink jet recording sheet sample Nos. 21 through 28 were prepared in the same manner as in Ink jet recording sheet sample No. 1, except that the polymer latexes as shown in Table 3 was further added to Coating Solution 1. The resulting samples were evaluated in the same manner as in Example 1. The results are shown in Table 4.

TABLE 3

| Recording Sheet Sample No. | Additives (mp or Tg) | Average Oil Drop Size (μm) | *Addition Amount (wt %) |
|---|---|---|---|
| 21 (Invention) | ET/VA (Tg <20° C.) | 0.10 | 10 |
| 22 (Invention) | ET/VA (Tg <20° C.) | 0.10 | 30 |
| 23 (Comparative) | ET/VA (Tg <20° C.) | 0.10 | 60 |
| 24 (Invention) | ST/BA/HEMA (Tg <20° C.) | 0.09 | 10 |
| 25 (Invention) | ST/BA/HEMA (Tg <20° C.) | 0.09 | 30 |
| 26 (Comparative) | ST/BA/HEMA (Tg <20° C.) | 0.09 | 60 |
| 27 (Comparative) | ST (Tg: about 100° C.) | 0.12 | 20 |
| 28 (Comparative) | BMA (Tg: about 57° C.) | 0.08 | 20 |

ET/VA: Ethylene/ethyl acetate (10/90) copolymer latex
ST/BA/HEMA: Styrene/butylacrylate/hydroxyethylmethacrylate (20/70/10) copolymer latex
ST: Polystyrene latex
BMA: Poly butylmethacrylate latex
*In Table 3, the addition amount represents the additive weight content based on the silica weight.

TABLE 4

| Recording Sheet Sample No. | Ink Absorption | Cracks | Glossiness |
|---|---|---|---|
| 21 (Invention) | 0.05 | B | 62% |
| 22 (Invention) | 0.07 | B | 64% |
| 23 (Comparative) | 0.13 | A | 48% |
| 24 (Invention) | 0.05 | B | 59% |
| 25 (Invention) | 0.06 | B | 57% |
| 26 (Comparative) | 0.11 | B | 45% |
| 27 (Comparative) | 0.07 | D | 51% |
| 28 (Comparative) | 0.08 | C | 42% |

As is apparent from Table 4, Recording Sheet Sample Nos. 21, 22, 24 and 25, which employed the polymer latex with a glass transition temperature not more than 40° C. in the amount of 5 to 50 weight % based on the silica weight, greatly improved the layer strength without lowering ink absorption and glossiness. In contrast, Recording Sheet Sample Nos. 23, and 26, which employed the polymer latex in the amount exceeding 50 weight % based on the silica weight, improved the layer strength but exhibited lowering of ink absorption and glossiness. Further, samples employing a polymer latex having a glass transition temperature exceeding 40° C. exhibited no improved layer strength.

Example 3

The following Coating Solution-2 was coated on a paper support, in which a polyethylene film was laminated on both surfaces of a 100 g/m$^2$ base paper, to give a wet thickness of 150 μm, dried, and then, Coating Solution-3 was further coated on the above coated layer and dried to obtain an ink absorption layer. The paper support was a support having a thickness of 140 μm in which a polyethylene film containing an anatase type titanium dioxide in an amount of 7 weight % was laminated on the surface of the base paper on the ink recording layer side, and a layer containing an alkali-processed gelatin in an amount of 4.2 g/m$^2$ and a hardener was provided on the surface of the support opposite the ink recording layer.

| (Coating Solution-2) | |
|---|---|
| Pure water | 980 ml |
| Fine particle silica having an average particle size of about 0.007 μm | 48.0 g |
| Polyvinyl alcohol (PVA 3500) of an average polymerization degree of 3,500 (saponification degree of 94%) | 10.8 g |
| Surfactant-1 (AS-1) | 1.2 g |

Thereafter, the following Coating Solution-3 was coated on the ink absorption layer to give a wet thickness of 8 μm, and dried. Thus, Ink Jet Recording Sheet 31 was obtained.

| (Coating Solution-3) | |
|---|---|
| Pure water | 800 ml |
| Phenylcarbamoylated gelatin (carbamoylation degree of about 88%) | 40 g |
| Polyvinyl pyrrolidone (K-90) | 25 g |
| Polyethylene oxide (average molecular weight: about 150,000) | 12 g |
| Surfactant-2 (AS-5) | 0.7 g |
| Hardener-1 | 2.1 g |

AS-5

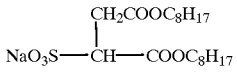

Hardener-1

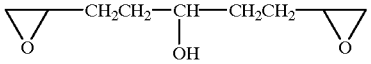

Ink jet recording sheet sample Nos. 32 through 35 were prepared in the same manner as in Ink Jet Recording Sheet Sample No. 31, except that dispersions as shown in Table 5 was further added to Coating Solution 2.

Each dispersion was added in the form of aqueous solution or dispersion, but the pure water amount was added to keep the total amount of the coating solutions constant.

TABLE 5

| Recording Sheet Sample No. | Dispersion | *Amount of Oil Drops (wt %) |
|---|---|---|
| 31 (Comparative) | None | 0 |
| 32 (Invention) | LP Dispersion 60 ml | 10 |
| 33 (Invention) | LP Dispersion 250 ml | 42 |
| 34 (Comparative) | LP Dispersion 600 ml | 100 |

LP Dispersion: 8% liquid paraffin dispersion
*Amount of Oil Drops represents the oil drop content based on the silica weight content.

The resulting samples were evaluated in the same manner as in Example 1. The results are shown in Table6.

TABLE 6

| Recording Sheet Sample No. | Ink Absorption | Cracks | Glossiness |
|---|---|---|---|
| 31 (Comparative) | 0.10 | D | 74% |
| 32 (Invention) | 0.12 | C | 72% |
| 33 (Invention) | 0.13 | B | 68% |
| 34 (Comparative) | 0.19 | B | 48% |

As is apparent from Table 6, recording sheet samples having, as an outermost layer, a swelling layer containing gelatin as a main component lowers ink absorption but improves glossiness. Among these, Recording Sheet Samples Nos. 32 and 33 greatly improved the layer strength without lowering ink absorption and glossiness. In contrast, Recording Sheet Sample No. 34, which employed liquid paraffin in the amount of 100 weight % based on the silica weight, improved the layer strength but exhibited greatly lowered ink absorption and glossiness.

Example 4

Ink jet recording sheet sample Nos. 41 was prepared in the same manner as in Ink Jet Recording Sheet Sample No. 31 of Example 3, except that the following Coating Solution 2a was used instead of Coating Solution 2.

Ink jet recording sheet sample Nos. 42 through 44 were prepared in the same manner as in Ink Jet Recording Sheet Sample No. 41 above, except that the dispersions as shown in Table 7 were further added to the Coating Solution 2a.

| (Coating Solution 2a) | |
|---|---|
| Pure water | 920 ml |
| Fine particle calcium carbonate having an average particle size of about 0.03 μm | 120.0 g |
| Polyvinyl alcohol (PVA 1700) of an average polymerization degree of 1700 (saponification degree of 90%) | 6.2 g |
| Surfactant-1 | 1.0 g |

TABLE 7

| Recording Sheet Sample No. | Dispersions | *Amount of Oil Drops (wt %) |
|---|---|---|
| 41 | None | — |
| 42 | DIDP Dispersion 60 ml | 5 |
| 43 | DIDP Dispersion 250 ml | 21 |
| 44 | DIDP Dispersion 600 ml | 54 |

DIDP Dispersion: 10 wt % diisodecylphthalate disperion
*In Table 7, the amount represents the oil drop content based on the silica weight.

The resulting samples were evaluated in the same manner as in Example 3. The results are shown in Table 8.

TABLE 8

| Recording Sheet Sample No. | Ink Absorption | Cracks | Glossiness |
|---|---|---|---|
| 41 (Comparative) | 0.14 | D | 75% |
| 42 (Invention) | 0.14 | C | 74% |
| 43 (Invention) | 0.15 | B | 70% |
| 44 (Comparative) | 0.23 | B | 53% |

As is apparent from Table 8, recording Sheet Samples employing fine particle calcium carbonate as solid fine particles exhibited the same results as Example 3.

Example 5

Ink jet recording sheet samples were prepared in the same manner as in Example 4, except that fine particle calcium carbonate of Coating Solution 3 was replaced with fine particle magnesium silicate (average particle size 30 nm, thickness about 1 nm), and evaluated in the same manner as in Example 4. The same results as Example 4 were obtained.

What is claimed is:

1. An ink-jet recording sheet comprising a support, and provided thereon, an ink absorption layer containing, in admixture, solid fine particles, a hydrophilic binder having an average polymerization degree of 2,000 to 4,000, and oil drops in an amount of 5 to 50 weight % based on the solid fine particle weight, the content ratio by weight of the solid fine particles to the hydrophilic binder being 2 to 200, wherein the hydrophilic binder is polyvinyl alcohol or cation-modified polyvinyl alcohols, and the oil drops comprise a hydrophobic organic compound having a melting point of 40° C. or less and a solubility in water at room temperature of 0.1 weight % or less or polymer particles having a glass transition temperature of 40° C. or less, said polymer particles being obtained from a polymer latex selected from the group consisting of a styrene-butadiene copolymer latex, a polyacrylate latex, a polymethacrylate latex, a polyvinyl acetate latex, and an ethylene-vinyl acetate copolymer latex.

2. The ink-jet recording sheet of claim 1, wherein the oil drops have an average oil drop size of 0.05 to 0.5 μm.

3. The ink-jet recording sheet of claim 2, wherein the solid fine particles are selected from the group consisting of silica, calcium carbonate, alumina, hydrated alumina and magnesium silicate, each having an average primary order particle size of 7 to 80 nm.

4. The ink-jet recording sheet of claim 1, wherein the solid fine particles are selected from the group consisting of silica, calcium carbonate, alumina, hydrated alumina and magnesium silicate, each having an average primary order particle size of 7 to 80 nm.

5. The ink-jet recording sheet of claim 1, wherein the solid fine particles are manufactured by a gas phase reaction method.

6. The ink-jet recording sheet of claim 1, wherein the hydrophilic binder is polyvinyl alcohol.

7. The ink-jet recording sheet of claim 1 wherein the oil drops comprise said polymer particles.

8. The ink-jet recording sheet of claim 7, wherein the oil drops have an average oil drop size of 0.05 to 0.5 μm.

9. The ink-jet recording sheet of claim 1, wherein said oil drops comprise said hydrophobic organic compound.

10. The ink-jet recording sheet of claim 1, wherein the hydrophilic binder is cation modified polyvinyl alcohol.

11. The ink-jet recording sheet of claim 1, wherein the support is a water-repellent support.

12. The ink-jet recording sheet of claim 11, wherein the ink absorption layer has a thickness of 10 to 60 μm.

13. The ink-jet recording sheet of claim 1, wherein the ink absorption layer has a thickness of 10 to 60 μm.

* * * * *